US005210517A

United States Patent [19]

Abe

[11] Patent Number: 5,210,517

[45] Date of Patent: May 11, 1993

[54] SELF-RESETTING OVERCURRENT PROTECTION ELEMENT

[75] Inventor: Toshiaki Abe, Tokyo, Japan

[73] Assignee: Daito Communication Apparatus Co., Ltd., Tokyo, Japan

[21] Appl. No.: 709,497

[22] Filed: Jun. 3, 1991

[30] Foreign Application Priority Data

Jun. 15, 1990 [JP] Japan ..... 2-156917

[51] Int. Cl.[5] ..... H01C 7/10; H01C 1/14

[52] U.S. Cl. ..... 338/22 R; 338/226; 338/275; 338/276; 338/322; 338/324; 338/327; 338/328

[58] Field of Search ..... 338/22 R, 22 SD, 272, 338/273, 275, 276, 322, 324, 327, 328, 226

[56] References Cited

U.S. PATENT DOCUMENTS 4,873,507 10/1989 Antonas ..... 338/22 R

FOREIGN PATENT DOCUMENTS 1-21601 4/1989 Japan .

*Primary Examiner*—Marvin M. Lateef

*Attorney, Agent, or Firm*—Morrison Law Firm

[57] ABSTRACT

A self-resetting overcurrent protection element uses an element body made up of a mixture of polymers and carbon black grafted with polymers. A resilient sheathing material covering the element body permits free expansion of the element body to permit the resistance of the overcurrent protection element to increase substantially in response to Joule's heating from high current. The sheathing materials preferably are made of elastic epoxy resins or silicone resins that allow significant expansion of the element body at the time of overcurrent protection, thus increasing the ratio of resistance in the element between an overcurrent state and a normal operating state.

4 Claims, 3 Drawing Sheets

SELF-RESETTING OVERCURRENT PROTECTION ELEMENT

BACKGROUND OF THE INVENTION

1. Field of the Invention

The present invention relates to a self-resetting overcurrent protection element using organic composition with PTC (positive temperature coefficient) characteristics.

2. Description of the Prior Art

Conventionally, a self-resetting overcurrent protection element using an organic composition with positive temperature characteristics has an element body with electrodes attached to opposite sides of the element body and a lead wire connected to each electrode. A sheathing material is wrapped around the structure with the lead wires extending therefrom. Epoxy resins, phenolic resins, or epoxidized phenolic resins are generally used for the sheathing material. All of these resins have high tensile stress capability when the elongation ratio is 10%, as well as an extremely low elongation ratio at the fracture point.

Another example of a self-resetting overcurrent element is described in Japanese Patent Publication No. 21601/1989. A positive characteristic thermistor is described wherein a case is used as the sheathing material. Lead wires having spring-like contacts are inserted into the case, connecting the lead wires to the electrodes. The spring tension exerted by the contacts on the electrodes also holds the element body and electrodes together.

A brief explanation of the principle of current limiting action of a self-resetting overcurrent protection element follows:

When an overcurrent occurs in a circuit using a self-resetting overcurrent protection element, the overcurrent protection element in the circuit generates Joule's heat. The heat causes the element body, which is made of polymer and conductive particles dispersed therein, to expand. As a result of this expansion, the conductive particles, which were dispersed in the element body and generally in contact with each other, separate, causing fewer particles to be in contact with each other. This causes the resistance of the element body to increase and current in the circuit to decrease, thereby limiting current in the circuit.

The efficiency and reliability of the current-limiting element are dependent upon the ability of its Positive Temperature Coefficient (hereinafter referred to as PTC) characteristics to maintain a high ratio of resistance between non-current limiting and current limiting situations.

When epoxy resin is used as the sheathing material in the first mentioned conventional overcurrent protection element, it exhibits high tensile stress when the elongation ratio is 10% during a tensile test and an extremely low elongation ratio at the time of fracture. This type of sheathing material presents the following problems: (1) A sheathing material with high tensile stress hinders the expansion of the element body at the time of current limiting action. Its low elongation ratio suppresses thermal expansion of the overcurrent protection element, thereby limiting the separation of conductive particles in contact with each other in the element body during an overcurrent condition. Consequently, the PTC characteristics of the element are restricted, thereby limiting the increase in resistance of the element at the time of current limiting action, and; (2) When thermal expansion of the element body exceeds a certain point, cracks occur in the sheathing material surface due to its low elongation ratio. As a result, the element body is exposed to outside atmosphere and its characteristics, such as, for example, voltage durability, deteriorate more rapidly than would otherwise occur.

The positive temperature characteristic thermistor described in Japanese Patent Publication No. 21601/1989 presents another problem in that the spring force exerted by the contacts of the lead wires on the electrodes and the element body suppresses adequate expansion of the PTC element body.

OBJECTS AND SUMMARY OF THE INVENTION

In order to overcome the above described problems, it is an object of the present invention to provide a PTC self-resetting overcurrent protection element that is capable of significantly increasing its resistance at the time of current limiting action. It is a further object of the invention to provide a PTC self-resetting overcurrent protection element that does not restrict thermal expansion of the element body at the switching temperature and is immune from cracks occurring in its sheathing material at the time of thermal expansion of the element body.

A self-resetting PTC overcurrent protection element according to the present invention has an organic positive temperature characteristic element body, which consists of a combination of crystalline polymer and conductive particles dispersed therein. Electrodes are connected to the element body and lead wires are connected to the electrodes. A sheathing material provides insulation and wrapping for the element body and its attached components. The sheathing material has a tensile stress of not more than 0.4 kg f/mm$^2$ when the elongation ratio is 10% at the switching temperature as well as an elongation ratio of not less than 5 % at the time of fracture.

According to another embodiment of the invention, a PTC self-resetting overcurrent protection element is provided with an insulating sheathing material made of elastic epoxy resins or silicone resins. The insulating sheathing material used requires no more than 0.4 kg f/mm$^2$ of tensile stress to produce an elongation ratio of 10% and provides at least a 5% elongation ratio at the time of fracture. Thermal expansion is less restrictive at the time of current-limiting action, thus allowing significant expansion of the element body. Thermal expansion of the element body reduces the number of conductive particles in contact with each other inside the element body, causing a substantial increase in resistance at the time of current limiting action. The PTC characteristics of the present invention at the time of current limiting action are greater than conventional PTC self-resetting overcurrent elements. Furthermore, since the elongation ratio of the sheathing material is large, cracks in the sheathing material do not occur when the element body experiences thermal expansion as a result of an overcurrent condition.

Briefly stated, the present invention provides a self-resetting overcurrent protection element using an element body made up of a mixture of polymers and carbon black grafted with polymers. A resilient sheathing material covering the element body permits free expansion of the element body to permit the resistance of the overcurrent protection element to increase substantially in response to Joule's heating from high current. The sheathing materials preferably are made of elastic epoxy resins or silicone resins that allow significant expansion of the element body at the time of overcurrent protection, thus increasing the ratio of resistance in the element between an overcurrent state and a normal operating state.

According to an embodiment of the invention, there is provided a self-resetting overcurrent protection element comprising: an organic positive temperature characteristic element body, at least two electrodes connected to said element body, an insulating sheathing material covering said element body and at least a portion of said at least two electrodes, said self-resetting overcurrent protection element having an overcurrent switching temperature, said sheathing material, at said overcurrent switching temperature, requiring a tensile stress of not more than 0.4 kg f/mm$^2$ to produce an elongation ratio of 10%, and said sheathing material having an elongation ratio at a fracture point of not less than 5%.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 6:
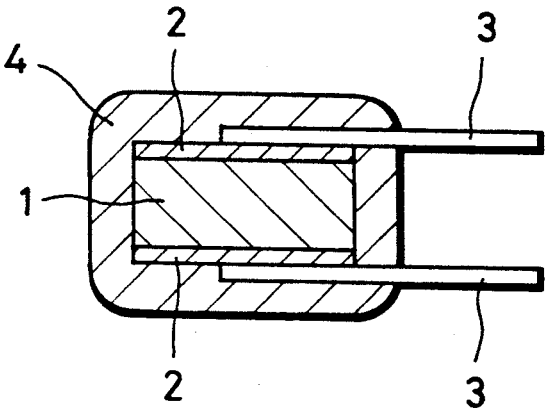
FIG. 6 (PRIOR ART)
FIG. 6 is a cross section of a conventional overcurrent protection element.

Referring to FIG. 6, a conventional self-resetting PTC overcurrent protection device is shown. The device has an element body 1 consisting of an organic composition with positive temperature characteristics. Electrodes 2 are attached to opposite sides of element body 1. A lead wire 3 is connected to each electrode 2. A layer of sheathing material 4 is wrapped around the structure. In the prior art, sheathing material 4 is made of epoxy resins, phenolic resins or epoxidized phenolic resins. All of these resins can withstand great tensile stress under tensile test when the elongation ratio is 10%, as well as an extremely low elongation ratio at the fracture point.

Figure 7:
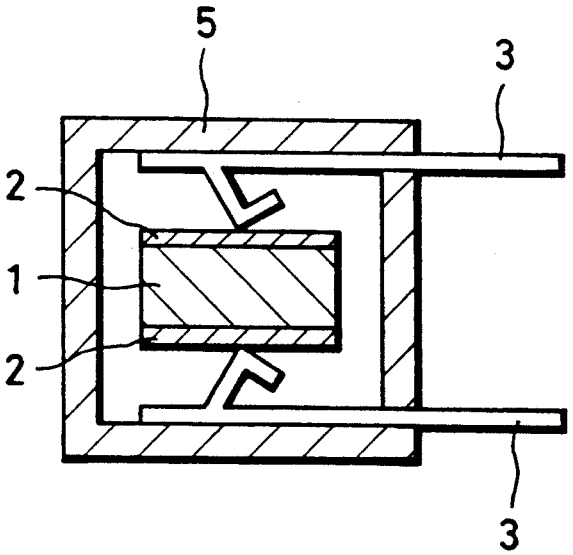
FIG. 7 (PRIOR ART)
FIG. 7 is a cross section of another conventional overcurrent protection element.

Referring to FIG. 7, another type of conventional self-resetting positive temperature characteristic thermistor, as described in Japanese Patent Publication No. 21601/1989, is shown. In this device, a case 5 is used as the sheathing material. Lead wires 3, having spring-like projecting contacts, are inserted into case 5 to connect lead wires 3 to electrodes 2. The spring-like force of the projecting contacts of lead wires 3 also hold electrodes 2 against element body 1.

THE FIRST EMBODIMENT

Two kinds of crystalline polymers, i.e., 82 g of high density polyethylene (Hizex 1300J manufactured by Mitsui Petro-chemical Industries Co.), 18 g of low density polyethylene (Ultzex 2022L manufactured by Mitsui Petro-chemical Industries Co.), 36 g of carbon black (Asahi #60H manufactured by Asahi Carbon Co.) as the conductive particles, and 36 g of aluminum hydroxide (B703 ST manufactured by Nippon Light Metal Co.) as inorganic filler are blended together. A quantity of 0.9 g of organic peroxide, more precisely dicumylperoxide (Percumyl D-40 manufactured by Nippon Oil and Fats Co.), is added as a grafting agent in order to graft the polyethylene onto the surfaces of carbon black particles so that the carbon black is well dispersed in the mixture.

Figure 1:
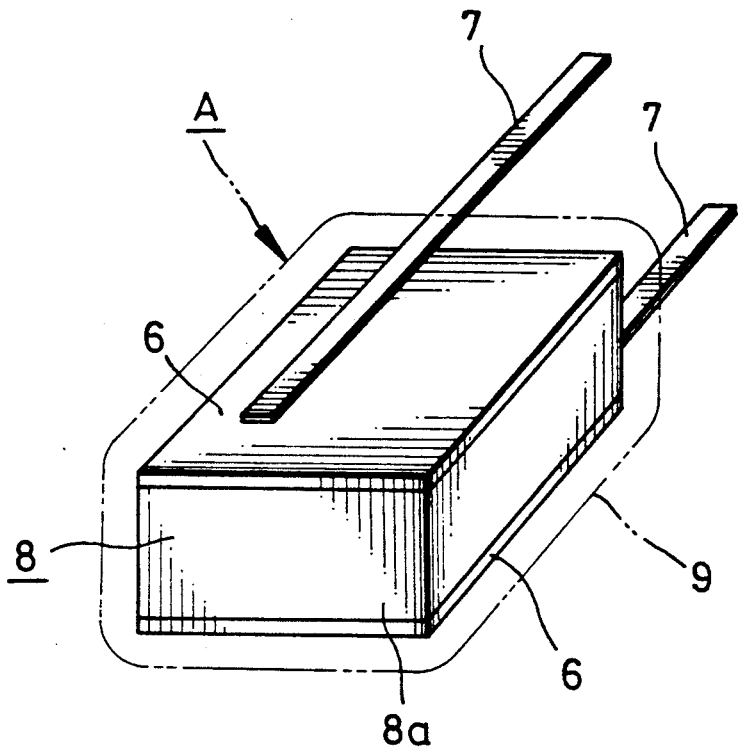
FIG. 1 is an oblique view showing an embodiment of a self-resetting overcurrent protection element according to the present invention.

Referring to FIG. 1, the above mixture is blended and kneaded with two rollers for 60 minutes at a constant temperature of 135° C. to obtain a molded product 8*a*. Metallic leaf electrodes 6 are attached to molded product 8*a* by thermal compression bonding and then treated with gamma radiation to cross-link the crystalline polymers. Next, lead wires 7 are spot-welded onto metallic leaf electrodes 6 of the cross-linked product to obtain the element body 8. The periphery of element body 8, including the spot-welded portions of lead wires 7, is coated with 1 mm thick silicone resin (KJR-4013 manufactured by Shinetsu Chemical Co.) as a sheathing material 9. Sheathing material 9 is allowed to harden at room temperature, then the entire structure is heated at 100° C. for two hours to obtain PTC element 10.

The resistance and PTC characteristic value of PTC element 10 were measured to be 5.0 ohms and 7.0 respectively with no cracks occurred in sheathing material 9. The PTC characteristics were measured according to the following procedure: PTC element 10 was placed in a constant temperature oven. Its resistance-temperature characteristics were measured while increasing the temperature of the oven until the temperature of PTC element 10 and the oven were both 150° C. The resistance of PTC element 10 reaches its maximum around 130° C., which is approximately the crystalline melting point of high density polyethylene, or the switching temperature of PTC element 10. The PTC characteristics value is the logarithm of the value produced by dividing the maximum resistance of the element by the resistance of the element at 20° C. as shown in the equation below:

$$PTC\ \text{characteristic} = \log R_{max}/R_{20^\circ\,C.}$$

$R_{max}$ is the maximum resistance of an element with respect to its resistance-temperature characteristics. $R_{20^\circ\,C.}$ hereinabove is the resistance of an element at 20° C. with regard to its resistance-temperature characteristics. The results of a tensile test of sheathing material 9 conducted at 130° C., when the elongation ratio of the silicone resin used as sheathing material 9 was 10%, tensile stress was 0.005 kg f/mm$^2$, and the elongation ratio at the fracture point was 200%. The tensile test was performed at 130° C., which is the switching temperature of PTC element 10, because the elongation ratio and tensile stress of sheathing material 9 at this temperature affect the thermal expansion of element body 8.

Figure 2:
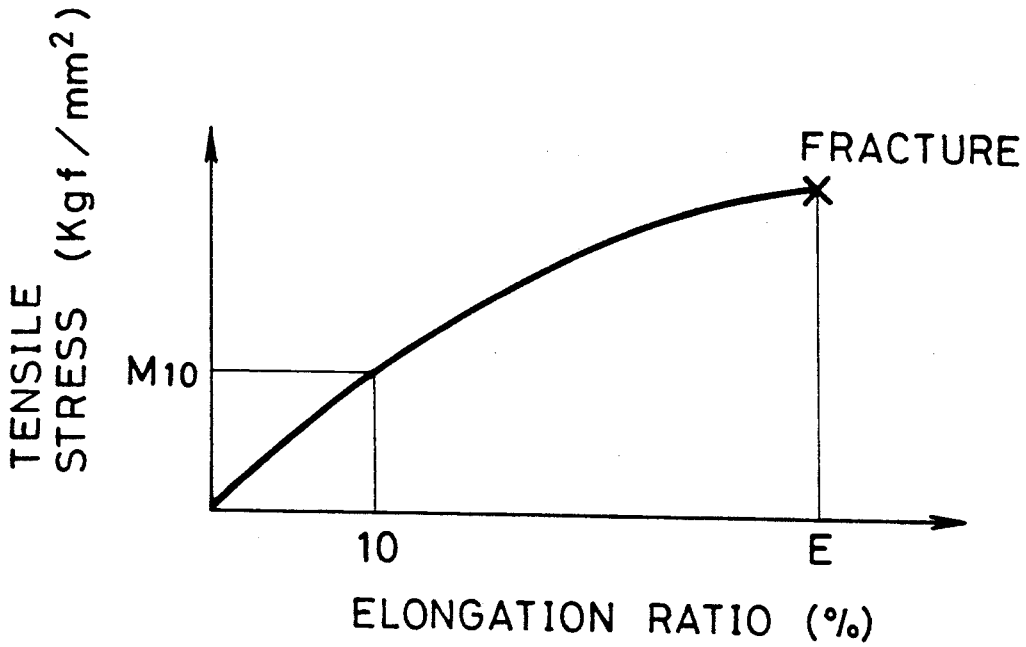
FIG. 2 shows the relationship between elongation ratio and tensile stress of sheathing material of the invention.

Tensile stress at the elongation ratio of 10% (hereinafter abbreviated as $M_{10}$) and elongation ratio at the fracture point (hereinafter abbreviated as E) is calculated as follows:

Referring to FIG. 2, silicone resin (KJR-4013) used as sheathing material 9 is molded into a dumbbell-shaped testing sample as shown in J1SK7113. The formed sample is pulled at a tensile speed of 10 mm/min, while its temperature is maintained at 130° C. in order to determine the relationship between the elongation ratio and tensile stress. $M_{10}$ and E are calculated from this relationship. $M_{10}$ and E are calculated according to JISK7113 as follows:

$$M_{10}=F_{10}/S$$

$M_{10}$ is tensile stress (kg f/mm$^2$) when the elongation ratio is 10%;

$F_{10}$ is load (kg f) when the elongation ratio is 10%;

S is the cross sectional area (mm$^2$) of the sample.

$$E=(L_1-L_0)/L_0\times 100$$

E is elongation ratio (%) at the fracture point;

$L_0$ is the distance (mm) between the original bench marks;

$L_1$ is the distance (mm) between the bench marks at the fracture point.

Consequently, when silicone resin having characteristics of $M_{10}=0.005$ kg f/mm$^2$ and E=200% is used as sheathing material 9, PTC characteristics of the element are 7.0, and no cracks are produced in sheathing material 9 by heat during measurement of resistance-temperature characteristics using PTC element 10.

THE SECOND EMBODIMENT

PTC element 10 and a sample for the tensile test are made in the same manner as the first embodiment with the exception of elastic epoxy resin being used (FEX-0106 manufactured by Yokohama Rubber Co.) for sheathing material 9. PTC characteristics of PTC element 10 and $M_{10}$ and E of sheathing material 9 are measured in the same manner as described in the first embodiment. Elasticity is produced in elastic epoxy resin having flexible main chain by creating network structure using amine-type hardener.

PTC element 10 is produced by coating element body 8 with the elastic epoxy resin serving as sheathing material 9 and heating the assembly at 100° C. for two hours. The PTC element 10 in this embodiment had a resistance value of 5 ohms and a PTC characteristic of 6.6. No cracks appeared in sheathing material 9. A tensile test indicated that $M_{10}$ and E of sheathing material 9 were 0.02 kg f/mm$^2$ and 20% respectively.

THE FIRST COMPARISON EXAMPLE

A PTC element 10 was produced for analysis by tensile test. The element's PTC characteristics and the sheathing material's $M_{10}$ and E were measured in the same manner as the first embodiment with the exception that powdered epoxy resin (ECP-275DA manufactured by Sumitomo Bakelite Co.) was used for the sheathing material. PTC element 10 was produced by coating element body 8 with powdered epoxy resin serving as the sheathing material and heating it at 100° C. for two hours. PTC element 10 had a resistance of approximately 5 ohms and PTC characteristics of 5.4. Cracks appeared in the sheathing material of some elements. $M_{10}$ of the sheathing material of the elements was greater than 0.5 kg f/mm$^2$ and its E was 1.9%.

THE SECOND COMPARISON EXAMPLE

A PTC element 10 was produced for analysis by tensile test. The element's PTC characteristics and the sheathing material's $M_{10}$ and E were measured in the same manner as the first embodiment with the exception that epoxidized phenolic resin (PR53365 manufactured by Sumitomo Bakelite Co.) was used for the sheathing material. PTC element 10 was produced by coating element body 8 with epoxidized phenolic resin serving as the sheathing material, drying it at room temperature, then heating it at 100° C. for two hours. PTC element 10 had a resistance of approximately 5 ohms and PTC characteristics of 4.9. Cracks appeared in the sheathing material of some elements. $M_{10}$ of the sheathing material of the elements was greater than 0.5 kg f/mm$^2$ and its E was 1.1%.

THE THIRD COMPARISON EXAMPLE

A PTC element 10 was produced in the same manner as the first embodiment with the exception that no sheathing material was used, and the element's PTC characteristics were measured. The resistance of the element was approximately 5 ohms and PTC characteristics were 7.1. The resistance and PTC characteristics of the elements and $M_{10}$ and E of the sheathing materials obtained in the first and second embodiments and the first through third comparison examples are shown in Table 1.

Figure 3:
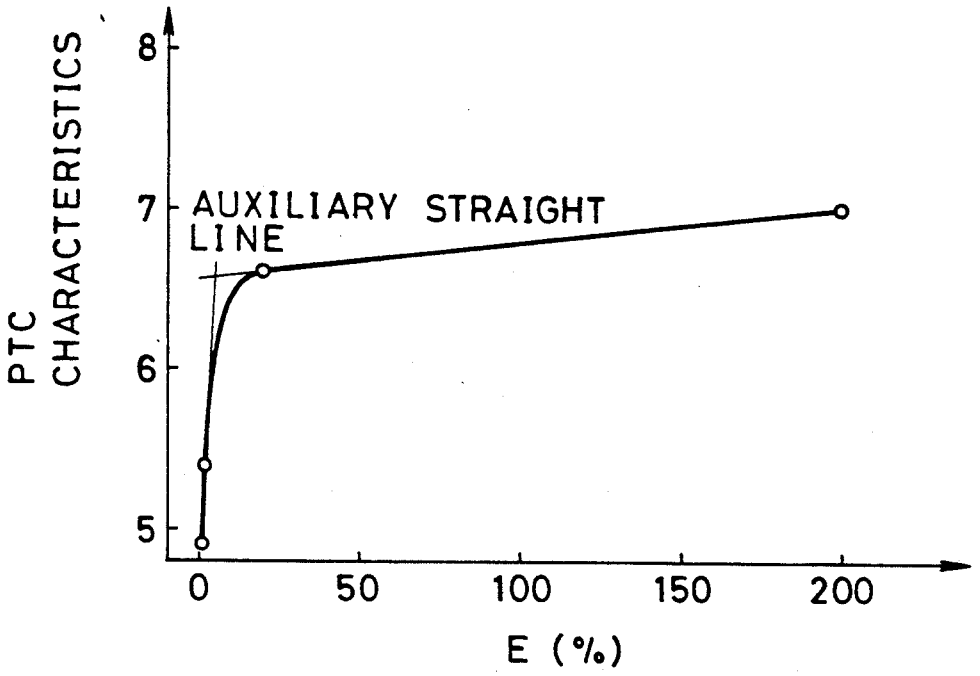
FIG. 3 shows the relationship between the Elongation Ratio (E) and PTC characteristics.

The following is evident in Table 1:

As indicated in the first and second embodiments, sheathing material with a smaller $M_{10}$ and a larger E produces an element having higher PTC characteristics. The elements of the first and second embodiments have PTC characteristics of approximately 7, which is about the same as that of the third comparison example, i.e., the element having no sheathing material. In order to analyze the relationship between E and PTC characteristics in more detail, a curvilinear diagram of E and PTC characteristics was made by plotting E and PTC characteristics values shown in Table 1. This curve is shown in FIG. 3.

As evident in FIG. 3 when E falls below a certain value, the PTC characteristics decrease significantly. In order to find the value of E where the PTC characteristics drop off, two auxiliary straight lines were drawn so that the auxiliary straight lines are tangent to the curve of E and PTC characteristics plots, and the intersecting point of the two straight lines was found. The value of E indicated by the intersecting point was found to be that at which the PTC characteristics drop off. FIG. 3 indicates that this value of E is 5%.

Figure 4:
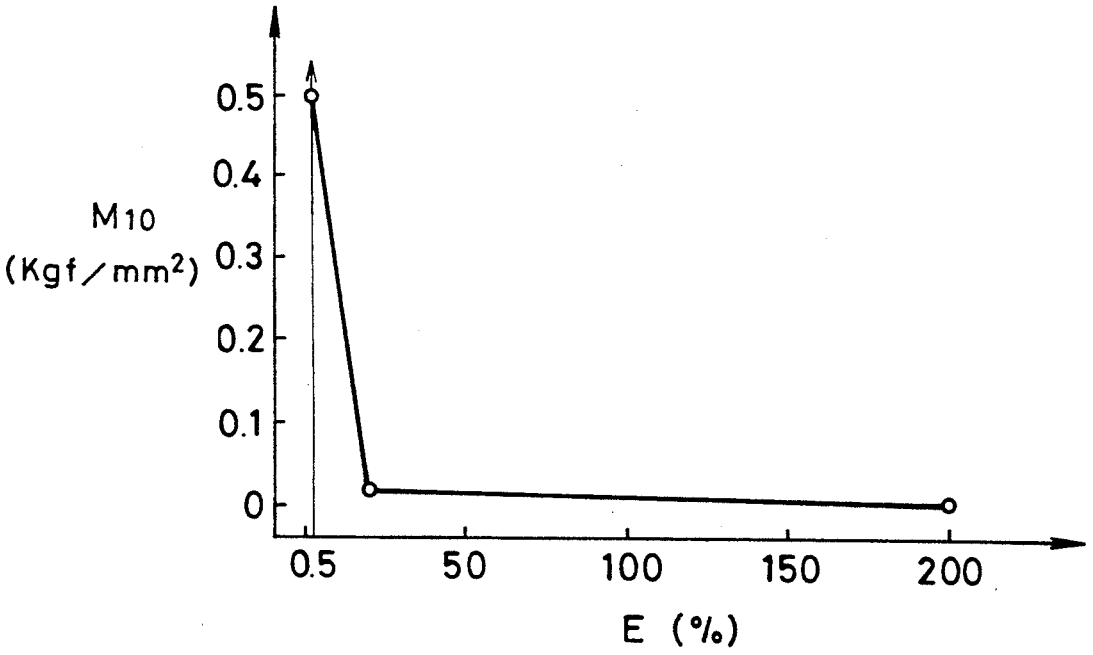
FIG. 4 shows the relationship between the Elongation Ratio (E) and the tensile stress of 10% ($M_{10}$).
Figure 5:
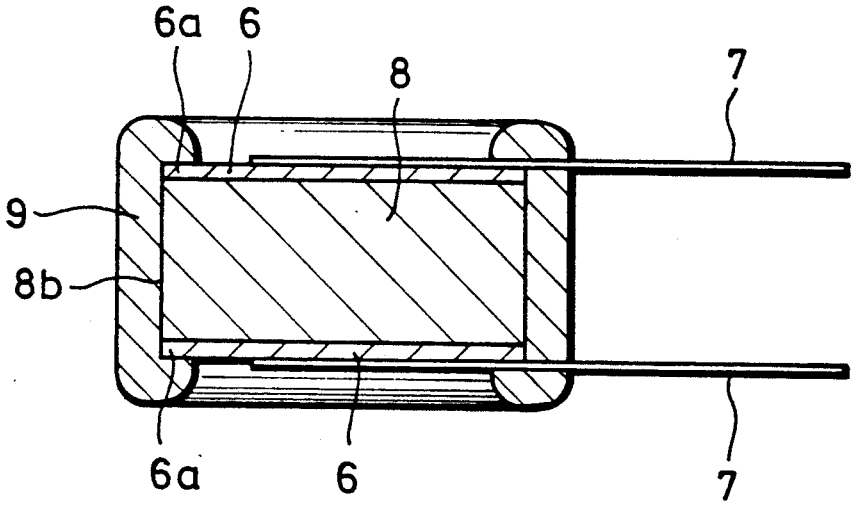
FIG. 5 is a cross section of another embodiment of a self-resetting overcurrent protection element according to the present invention.

Further, the relationship between E and $M_{10}$ was studied to find $M_{10}$ when E is 5%. The relationship between E and $M_{10}$ is shown in FIG. 4, which indicates that when E is 1.9%, $M_{10}$ is greater than 0.5 kg f/mm$^2$ and $M_{10}$ when E is 5% is greater than 0.4 kg f/mm$^2$. Consequently, when E (elongation ratio) and $M_{10}$ (tensile stress at elongation ratio of 10%) become smaller than 5% and greater than 0.4 kg f/mm$^2$ respectively, PTC characteristics decrease significantly. Still further, the above embodiments illustrate a structure, as shown in FIG. 1, in which the entire element body 8, as well as electrodes 6 and a part of lead wires 7, is wrapped in sheathing material 9. However, as shown in FIG. 5, a structure wherein the portion of element body surface 8*b* not touching electrodes 6 is disposed on the upper and lower ends of element body 8, and electrode surfaces 6*a* of electrodes 6 are covered with sheathing material 9, is also possible.

According to the present invention, it is possible to maintain high PTC characteristics by making sheathing material for the element body having no more than 0.4 kg f/mm$^2$ of tensile stress when the elongation ratio is 10% and the elongation ratio is not less than 5% at the fracture point.

Because of the large elongation ratio of the sheathing material, thermal expansion of element body 8 is not hindered, and the occurrence of cracks in the sheathing material is extremely small. Furthermore, since a sheathing material with small tensile stress at the elongation ratio of 10% as well as large elongation ratio at the fracture point is elastic, it allows adequate expansion and contraction of element body 8 caused by repeated current limiting action, thereby preventing electrodes 6 from peeling away from element body 8.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

1. A self-resetting overcurrent protection element comprising:

an organic positive temperature characteristic element body;

at least two electrodes connected to said element body;

an insulating sheathing material covering said element body and at least a portion of said at least two electrodes;

said self-resetting overcurrent protection element having an overcurrent switching temperature;

said sheathing material, at said overcurrent switching temperature, requiring a tensile stress of not more than 0.4 kg f/mm$^2$ to produce an elongation ratio of 10%; and said sheathing material having an elongation ratio at a fracture point of not less than 5%.

2. A self-resetting overcurrent protection element according to claim 1 wherein said sheathing material is one of elastic epoxy resins and elastic silicone resins.

3. A self-resetting overcurrent protection element according to claim 1, further comprising:

a lead wire connected to each of said electrodes; and at least a portion of each of said lead wires being covered by said insulating sheathing material.

4. A self-resetting overcurrent protection element according to claim 3, wherein all of said at least two electrodes are covered by said insulating sheathing material.

TABLE 1

| | sheathing material | resistance valve of element (Ω) | PTC characteristics | whether cracks occurred on sheathing material at the time of measurement of resistance-temperature characteristics | tensile stress ($M_{10}$) when elongation ratio is 10% (kgf/m$^2$) | elongation ratio (E) at the fracture point (%) |
|---|---|---|---|---|---|---|
| first embodiment | silicone resin | 5 | 7.0 | No | 0.005 | 200 |
| second embodiment | elastic epoxy resin | 5 | 6.6 | No | 0.02 | 20 |
| first comparison example | powdered epoxy resin | 5 | 5.4 | cracks appeared on some elements | >0.5 | 1.9 |
| second comparison example | epoxidized phenolic resin | 5 | 4.9 | cracks appeared on some elements | >0.5 | 1.1 |
| third comparison example | No sheathing material | 5 | 7.1 | — | — | — |

What is claimed is:

* * * * *